United States Patent [19]

Kato et al.

[11] Patent Number: 4,611,695

[45] Date of Patent: Sep. 16, 1986

[54] AUTOMATIC PAINTING SYSTEM

[75] Inventors: Yoshito Kato; Shuichi Sunahara; Takayuki Tanaka; Hiroshi Takahashi, all of Toyota, Japan

[73] Assignee: Toyota Jidosha Kabushiki Kaisha, Toyota, Japan

[21] Appl. No.: 771,152

[22] Filed: Aug. 30, 1985

Related U.S. Application Data

[63] Continuation of Ser. No. 628,287, Jul. 6, 1984, abandoned.

[30] Foreign Application Priority Data

Jul. 6, 1983 [JP] Japan ..... 58-105071[U]

[51] Int. Cl.[4] ..... B05B 15/12

[52] U.S. Cl. ..... 118/323; 118/326; 901/43

[58] Field of Search ..... 118/323, 326; 901/43, 901/50

[56] References Cited

U.S. PATENT DOCUMENTS

| | | | |
|---|---|---|---|
| 3,315,639 | 4/1967 | Close | 118/326 |
| 3,434,416 | 3/1969 | Testone | 118/326 |
| 3,500,741 | 3/1970 | Bok | 118/326 |
| 3,606,162 | 9/1971 | Lehmann | 118/323 X |
| 3,874,595 | 4/1975 | Rindisbacher | 118/323 X |
| 3,998,388 | 12/1976 | Alagna | 118/323 X |
| 4,224,355 | 9/1980 | Lampkin et al. | 118/323 X |
| 4,278,046 | 7/1981 | Clarke et al. | 118/695 |
| 4,323,030 | 4/1982 | Lehmann | 118/323 |

*Primary Examiner*—Shrive P. Beck

*Attorney, Agent, or Firm*—Oblon, Fisher, Spivak, McClelland & Maier

[57] ABSTRACT

An automatic painting system has a painting booth composed of a partition having side walls, a ceiling, and a floor which jointly define a working space isolated by the partition from exterior space for accommodating a workpiece to be painted in a position therein. The partition has air inlet and outlet ports opening into the working space. A movable painting mechanism such as a robot paint spray gun is disposed adjacent to the workpiece position and controlled by a control unit disposed outside of the painting booth and including a robot drive source. The control unit and the movable painting mechanism are interconnected by an arm accommodated in an arm housing extending through the partition with a sealing member hermetically sealing a gap between the arm housing and the partition. A door is mounted on the partition in the vicinity of the workpiece position for transfer of the workpiece into and out of the painting booth.

7 Claims, 4 Drawing Figures

AUTOMATIC PAINTING SYSTEM

This application is a continuation of application Ser. No. 628,287, filed July 6, 1984, now abandoned.

BACKGROUND OF THE INVENTION

1. Field of the Invention

The present invention relates to the art of automatic painting using an industrial robot, and more particularly to an improved automatic painting system for painting various parts.

2. Description of the Prior Art

Conventional automatic painting systems have painting devices and other devices placed in a closed painting booth in which an operator controls the devices to paint parts. The painting system therefore has required an explosion-proof arrangement for preventing an explosion, for some reasons, of a mist of paint having entered the devices in the painting booth. The painting system has also required an air conditioning unit such as an air curtain for blocking the paint mist against entry to make operator's environment more safe and comfortable. However, it has been difficult and costly to render every device in the painting booth resistant to explosions. Where the air curtain is employed for providing better operator's environments, air flows around the parts being painted are disturbed by the air curtain to thereby lower the efficiency with which the parts are painted. Furthermore, the air curtain has proven insufficient as a adequate means for improving the operator's environments. With the air curtain, a considerable quantity of air has to be supplied for keeping the environment better suited for the operator as well as for maintaining a desired quality of painting, and the cost of energy needed for supplying such a large amount of air is high. Another problem with the prior painting system is that the painting booth takes up a large space for accommodating the devices and the operator therein. The operator in the working space within the booth wears gloves and a mask which are a source of dust particles to be trapped in the coated paint layer resulting in a poor quality of painted parts. Where a robot continuously operable in a three-dimensional space is installed in the painting booth for automatic paint spraying, such robot comprises an explosion-proof hydraulically-operated robot, which however is large in size and consumes an increased amount of electric power. Thus, such a robot-operated painting system is expensive.

SUMMARY OF THE INVENTION

With the above prior problems in view, it is an object of the present invention to provide an automatic painting system which has, instead of a human operator, an electrically operated robot with a drive source comprising a DC motor, is small in size, and has a sufficient explosion-proof capability.

An automatic painting system according to the present invention includes a painting booth composed of a partition having side walls, a ceiling, and a floor which jointly define a working space isolated by the partition from exterior space for accommodating a workpiece therein to be painted. The partition has air inlet and outlet ports opening into the working space. A movable painting means such as a robot paint spray gun is disposed adjacent the workpiece position and is controlled by a control unit disposed outside the painting booth and including a robot drive source. The control unit and the movable painting means are interconnected by an arm accommodated in an arm housing extending through the partition with a sealing member hermetically sealing a gap between the arm housing and the partition. A door is mounted on the partition in the vicinity of the workpiece position for transfer of the workpiece into and out of the painting booth therethrough.

The automatic painting system has a minimum number of parts located in the closed working space with the control unit and an operator outside the working space.

The workpiece is painted by an automatic painting machine or robot which is composed of the movable painting means and the control unit for automatically painting the workpiece at high speed and with accuracy. The control unit is disposed outside of the closed working space and the movable painting means is located in the working space. The control unit and the movable painting means are mechanically interconnected by the arm in the arm housing extending through the partition with a seal member interposed between the partition and the arm housing.

The workpiece can be brought into and out of the working space through the door mounted on the partition in the vicinity of the workpiece position, the door being normally disposed on one of the side walls. The door may be manually opened and closed, or automatically opened and closed under the control unit in coaction with the painting machine.

The air flows into the working space from the air inlet port to cause a mist of paint from the movable painting means to be deposited efficiently on the workpiece and flows out of the working space from the air outlet port to carry therewith the excessive paint mist. The air inlet and outlet ports should be located one on each side of the workpiece position in the working space. The movable painting means has a paint ejecting hole positioned on a side of the workpiece position which is closer to the air inlet port. The air inlet port has filter means such as an air filter for preventing undesired dust from entering the working space. It is desirable that the air flow through the working space be adjusted. The best air adjustment mode is that before the door is opened, the air flow is increased to discharge any residual paint mist and organic solvent from the air outlet port, and thereafter the air flow is stopped and then the door is opened.

A water flow path is disposed in a lower portion of the working space and opens thereinto for preventing excessive paint from becoming attached to surrounding surfaces.

With the automatic painting system of the invention, the operator can work in a desirable working environment without the danger of inhaling an organic solvent in the working space. There is required no air curtain in the working space for the purpose of protecting the operator. Therefore, the air flow through the working space can be adjusted to optimize the efficiency with which the paint is applied to the workpiece. As no dust enters the working space during operation, a high-quality coating of paint can be deposited on the workpiece. The number of components of the automatic painting machine within the working space is few since the control unit including the drive source is located outside of the working space, with the result that the cost of making such components explosion-proof can be reduced.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
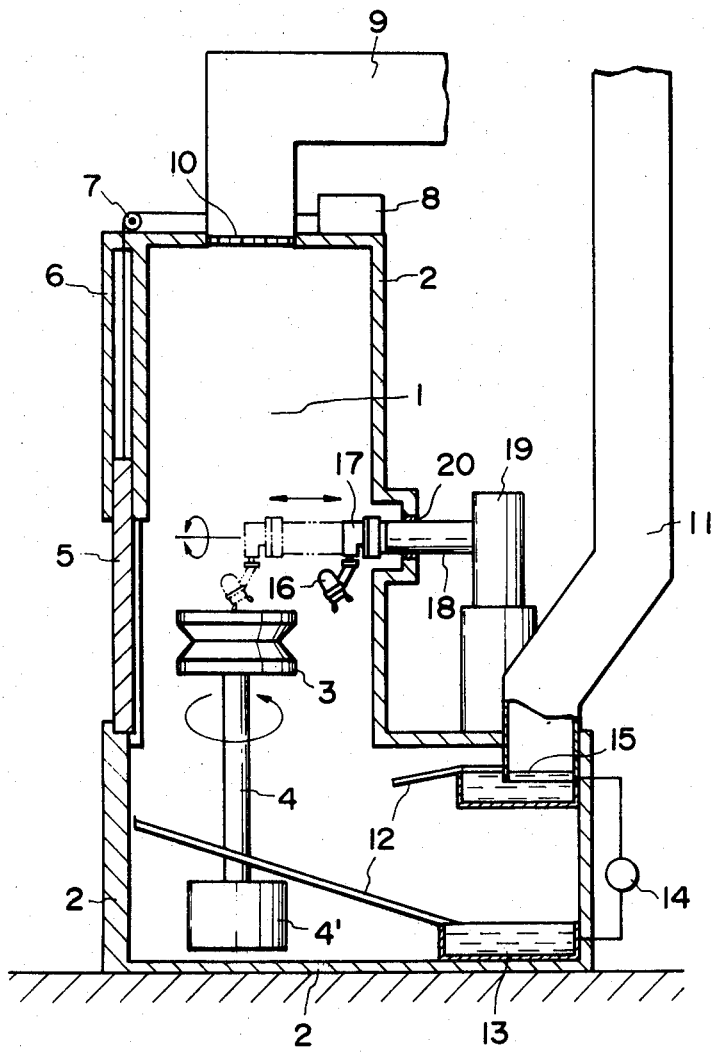
FIG. 1 is a side elevational view of an automatic painting system of the present invention, with a painting booth shown in cross section.
Figure 2:
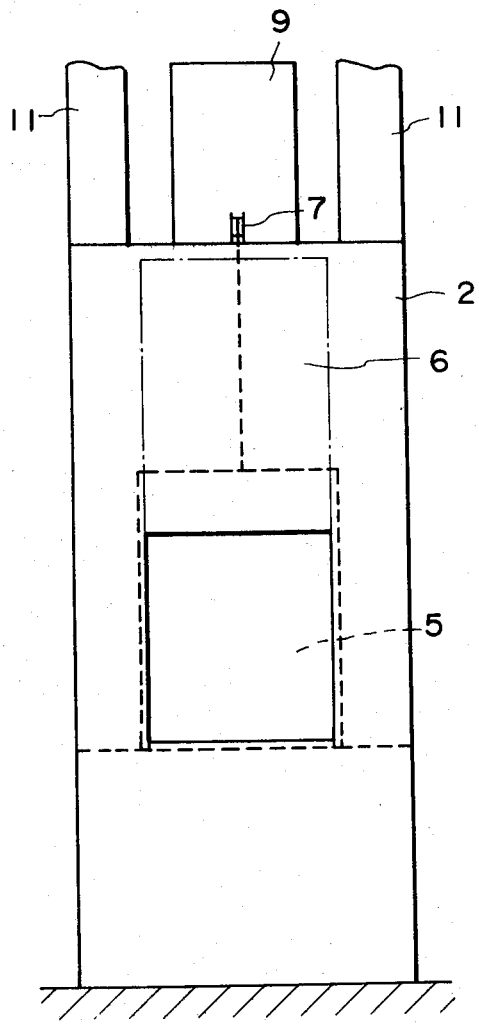
FIG. 2 is a front elevational view of the painting booth shown in FIG. 1.

As shown in FIGS. 1 and 2, an automatic painting system according to the present invention has a working space 1 defined by a partition 2 and isolated thereby from exterior space, the partition having side walls, a ceiling, and a floor which jointly serve as a painting booth. A workpiece or part 3 to be painted is located in the working space 1 and supported on a workpiece support 4 connected to an actuator 4'. The partition 2 has an automatic door 5 close to the workpiece 3 for taking the same into and out of the working space 1. The door 5 is supported by a door guide 6 for vertical opening and closing sliding movement caused through a chain 7 by a cylinder 8 mounted on the partition 2. The door 5 may be arranged to be opened and closed in a horizontal direction. An air inlet duct 9 is mounted on top of the partition 2 and has an air supply outlet port opening into the working space 1 and an opposite air inlet port connected to the air discharge port of an air blower (not shown). The air supply outlet port of the duct 9 has an air filter 10 for removing dust particles from air introduced into the working space 1. Air outlet ducts 11 are mounted on a lower portion of the partition 2 and each has an air outlet port opening into the working space 1 and located at a level below the workpiece 3. The working space 1 accommodates a water flow path 12 opening into the working space 1 and disposed in a lower portion thereof for preventing a mist of paint from getting attached to surrounding surfaces. Water form the water flow path 12 flows into a lower water tank 13, and is supplied by a pump 14 into an upper water tank 15, from which water flows back to the water flow path 12. A movable paint spray gun 16 is disposed in the working space 1 in the vicinity of the workpiece 3. The spray gun 16 is supported by a movable arm 17 accommodated in and connected through an arm housing 18 to a control unit 19 disposed outside of the working space 1. The arm housing 18 extends through the partition 2. A gap between the partition 2 and the arm housing 18 is hermetically sealed by a sealing member 20.

Figure 3:
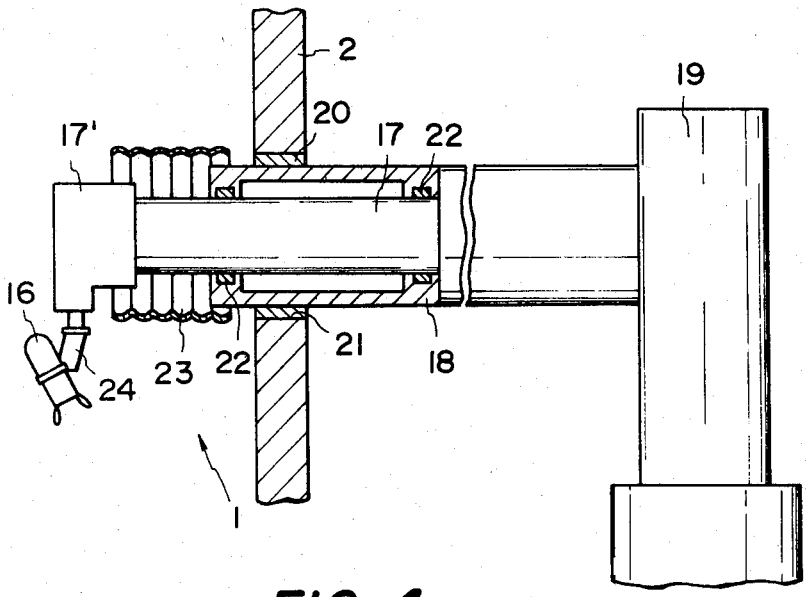
FIG. 3 is a cross-sectional view of an automatic painting machine and an attachment construction by which the automatic painting machine is attached to a partition.

FIG. 3 shows in cross section an automatic painting machine or robot as it is attached to the partition 2. The automatic painting machine has the arm housing 18 with the sealing member 20 placed in the gap between the arm housing 18 and an edge of the partition 2 defining an opening 21. The sealing member 20 is made of sealing resin, inflammable vinyl, or rubber, for example. The sealing member 20 isolates the control unit 19 of the automatic painting machine completely from the working space 1. Seal members or rings 22 are interposed between the movable arm 17 and the arm housing 18 to provide a hermetic seal therebetween. A bellows or extendible and contractable explosion-proof boot 23 is disposed around the arm 17 and extends in hermetically sealed relation from an end of the arm housing 18 and a distal end 17' of the arm 17. The spray gun 16 is coupled by a hand 24 to the distal end 17' of the arm 17.

Figure 4:
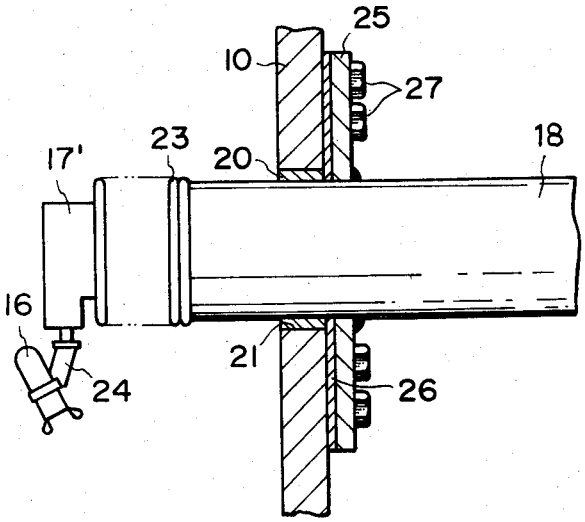
FIG. 4 is a cross-sectional view of an attachment construction according to another embodiment by which the automatic painting machine is attached to a partition.

FIG. 4 shows another arrangement in which an attachment plate 25 is secured to the arm housing 18 and fastened by bolts 27 to the partition 2 with a plate-like sealing member 26 interposed therebetween. The attachment plate 25 and the sealing member 26 provide an additional hermetical seal between the partition 2 and the arm housing 18.

Painting operation of the automatic painting system according to the present invention is as follows:

The workpiece 3 to be painted is installed on the support 4 by an operator, and then the automatic door 5 is closed by depressing a start button (not shown). Then, the spray gun 16 is actuated automatically by the control unit 19 for painting the workpiece 3. At the same time that the spray gun 16 starts painting the workpiece 3, the air blower (not shown) is started to supply air through the duct 9 into the working space 1. Therefore, an air flow is created downwardly (in FIG. 1) in the working space 1. When the spray gun 16 begins to paint the workpiece 3, the support 4 is continuously rotated by the actuator 4' to allow the workpiece 3 to be painted thoroughly. When a preset painting program in the control unit 19 is completed, the spray gun 16 stops painting operation, and with a certain time delay the air blower is de-energized to stop the air flow, whereupon the door 5 is opened to allow the workpiece 3 to be replaced with another workpiece to be painted. Then, the foregoing painting cycle is repeated.

In the above embodiment, the door 5, the spray gun 16, and the air inlet duct 9 are operated in ganged or coacting relation, but they may be manually operated. While the air inlet duct 9 and the air outlet ducts 11 are shown vertically spaced, they may instead be arranged in horizontally spaced relation. Although the spray gun 16 is shown as being a single gun, a plurality of such spray guns may be disposed in the working space 1. The support 4 may be indexed through incremental angular intervals rather than continuously rotated. The support 4 may also be provided with an ejector mechanism for automatically removing the painted workpiece from the support 4 after one painting process, so that the next workpiece can be installed immediately after the preceding cycle of painting operation.

With the automatic painting system according to the present invention, as is evident from the foregoing, the working space is isolated by the partition from the exterior space, and the spray gun of the robot, for example, is placed in the working space while the control unit including the drive source for the spray gun is disposed outside of the working space. The spray gun and the control unit is interconnected by the arm housing extending through the partition with the sealing member providing a hermetical seal between the partition and the arm housing. Therefore, the operator will be outside of the workpiece space in a much better working environment. The parts of the painting robot which are positioned in the working space are a few and can be rendered explosion-proof relatively easily. Since the operator is not in the working space, there is not required an air conditioning unit such as an air curtain, with the result that the workpiece can be painted with an increased efficiency. Furthermore, the automatic painting system is small in size as a whole and less costly to construct.

Although certain preferred embodiments have been shown and described, it should be understood that many changes and modifications may be made therein without departing from the scope of the appended claims.

What is claimed is:

1. An automatic painting system, comprising:

a sealed painting booth composed of a partition having a door for transferring a workpiece to be painted into and out of the painting booth, an air inlet port for supplying air to said painting booth and an air outlet port to discharge paint mist out of the painting booth;

an electrically-operated automatic painting robot and which comprises an arm having a spray gun, an arm housing accommodating said arm therein and extending through said partition, means for hermetically sealing said arm housing with respect to said partition from outside atmosphere, a control unit connected to said arm and disposed outside of said painting booth, and means for sealing said arm within said arm housing so as to allow for axial movement of said arm within said arm housing; and means for extending said arm within said arm housing towards and away from said control unit for movement of said spray gun within said painting booth wherein said means for extending said arm within said arm housing further comprises an explosion-proof boot extending between said arm housing and said arm in a hermetically sealed relation.

2. An automatic painting system according to claim 1, including an attachment plate extending fully around and secured to said arm housing, said attachment plate being attached to said partition with a sealing member interposed therebetween.

3. An automatic painting system according to claim 1 wherein said sealing member is made of resin or rubber.

4. An automatic painting system according to claim 1, wherein said spray gun has a plurality of pipes for supplying paint and air from outside of said painting booth to said spray gun.

5. An automatic painting system according to claim 1, including an air filter disposed in said air inlet port.

6. An automatic painting system according to claim 1, including water flow means disposed in a lower position in said painting booth.

7. An automatic painting system comprising:

a sealed painting booth composed of a partition having side walls, a ceiling, and a floor which jointly define a space for accommodating a workpiece to be painted therein;

air inlet and outlet ports defined in said partition for flowing air through said painting booth;

a movable paint spray gun disposed adjacent to said position in said space;

a control unit disposed outside of said painting booth for controlling said movable paint spray gun;

an arm housing extending through said partition;

means for hermetically sealing said arm housing with relation to said partition;

an arm connected to said spray gun and to said control unit and positioned within said arm housing;

means for sealing said arm within said arm housing so as to allow for axial movement of said arm within said arm housing;

a door mounted on said partition adjacent to said position in said space for inserting the workpiece into and removing the workpiece out of said painting booth therethrough; and means for extending said arm within said arm housing towards and away from said control unit for movement of said spray gun within said painting booth wherein said means for extending said arm within said arm housing further comprises an explosion-proof boot extending between said arm housing and said arm in a hermetically sealed relation.

* * * * *